US008411724B2

(12) United States Patent
Nosbisch

(10) Patent No.: US 8,411,724 B2
(45) Date of Patent: Apr. 2, 2013

(54) SILL AND DOOR JAMB ASSEMBLY FOR ELECTRIC ARC FURNACE

(75) Inventor: Lee A. Nosbisch, Chester, VA (US)

(73) Assignee: North American Refractories Company, Moon Township, PA (US)

( * ) Notice: Subject to any disclaimer, the term of this patent is extended or adjusted under 35 U.S.C. 154(b) by 1166 days.

(21) Appl. No.: 12/270,032

(22) Filed: Nov. 13, 2008

(65) Prior Publication Data

US 2010/0118910 A1 May 13, 2010

(51) Int. Cl.
*F27D 1/00* (2006.01)
*F23M 5/02* (2006.01)

(52) U.S. Cl. ..... 373/71; 373/72; 110/340

(58) Field of Classification Search ..... 373/71, 373/72, 73, 75, 44, 45; 52/598, 599; 110/331, 110/332, 338, 339, 340, 317, 318, 321, 181, 110/323, 336, 337; 432/67, 156, 197, 200, 432/237, 238, 250, 252, 262, 263, 264
See application file for complete search history.

(56) References Cited

U.S. PATENT DOCUMENTS

| | | | | | |
|---|---|---|---|---|---|
| 1,665,555 | A * | 4/1928 | Liptak | ..... | 110/181 |
| 3,315,430 | A * | 4/1967 | Reynolds et al. | ..... | 52/599 |
| 3,403,213 | A * | 9/1968 | Taylor et al. | ..... | 373/72 |
| 5,060,428 | A * | 10/1991 | Arthur et al. | ..... | 52/125.6 |
| 5,397,110 | A * | 3/1995 | Brezny et al. | ..... | 266/283 |

* cited by examiner

*Primary Examiner* — Henry Yuen
*Assistant Examiner* — Hung D Nguyen
(74) *Attorney, Agent, or Firm* — Kusner & Jaffe

(57) ABSTRACT

A sill and door jamb assembly providing an opening in an electric arc furnace, the sill and door jamb assembly having a sill block assembly and two jamb block assemblies. The sill block assembly having side-by-side sill blocks, each of the sill blocks being positioned side-by-side to form the sill block assembly and having an upper end and a lower end. The lower end of the sill block assembly is confined within a plurality of courses of the refractory bricks. Each jamb block assembly having a plurality of jamb blocks positioned side-by-side. Each of the jamb block assemblies having a lower end and an inner surface abutting the distal ends of the sill block assembly. The inner surfaces of the jamb block assemblies and the upper surface of the sill block assembly form the slag opening in the furnace.

26 Claims, 6 Drawing Sheets

SILL AND DOOR JAMB ASSEMBLY FOR ELECTRIC ARC FURNACE

FIELD OF THE INVENTION

The present invention relates to steel-making furnaces and more particularly to a structure for forming an opening in an electric arc furnace.

BACKGROUND OF THE INVENTION

An electric arc furnace used for steel making typically consists of a refractory-lined vessel, covered with a retractable roof through which one or more graphite electrodes extend. The furnace includes an outer shell that consists of side walls and bottom in the shape of a "bowl." Refractory materials line the bottom and side walls of the furnace. The inner surfaces of the side walls of the furnace are typically lined with continuous rings, i.e., continuous layers or courses, of refractory brick. The bricks in these continuous rings are tightly held in place as a result of each brick being constrained from movement by the adjacent bricks.

An electric arc furnace includes a slag discharge opening. This discharge opening is used to remove slag that typically forms along the upper surface of the molten metal within the electric arc furnace. The slag discharge opening is defined on the bottom by a sill formed by refractory bricks that are typically six (6) inches or less in height. The slag discharge opening creates a gap in the continuity of the courses of brick lining the inner surface of the side walls of the outer shell. In other words, a gap exists in the ring of bricks where the slag discharge opening is formed. Many steel makers simply stop laying the brick rings at the opening of the slag door. As will be appreciated, this configuration creates a structure wherein the bricks in the rings defining the slag opening are not constrained by adjacent bricks.

While the furnace can be operated with this type of construction, a problem exists following removal of slag through the slag discharge door. As slag is pulled or poured from the furnace through the slag opening, slag exiting the furnace flows over a sill area defined by the slag opening. Some residual slag may remain on the top of the sill where it can solidify, i.e., "build up," and accumulate over time. This slag "build up" eventually constricts the opening of the slag door, making it necessary to periodically remove the solidified slag. Typically, this is done by a device that mechanically strikes or impacts the slag, forcing it back into the furnace. The hammering and impacting forces, necessary to remove the slag, also have a tendency to damage the refractories (bricks) forming the sill and the surrounding slag opening. Because the bricks above the sill that form the opening are not confined or locked into a complete ring, and because the bricks that form the sill are generally six (6) inches or less in height, it is not unusual for the impact forces to dislodge bricks from the sill, and from the areas above the sill, forcing them into the furnace. Such an occurrence makes it necessary to repair the sill and the area above the sill, which is an expensive and time-consuming undertaking that affects the operation of the electric arc furnace.

The present invention provides a sill and jamb assembly for forming a slag opening in an electric arc furnace that is less susceptible to damage and dislodgement during a slag removal process.

SUMMARY OF THE INVENTION

In accordance with a preferred embodiment of the present invention, there is provided a sill and door jamb assembly providing an opening in an electric arc furnace. A shell is comprised of side walls and a bottom and a refractory layer lining the bottom and side walls. The refractory layer includes continuous courses of refractory bricks along the inner surfaces of the side walls of the shell. The sill and door jamb assembly is comprised of a sill block assembly and two jamb block assemblies. The sill block assembly is comprised of side-by-side sill blocks, each of the sill blocks having an upper end with an upper surface, a lower end with a lower surface, and an inner surface facing the interior of the furnace. The sill blocks are positioned side-by-side to form the sill block assembly and having an upper end and a lower end. The lower end of the sill block assembly is disposed between a plurality of courses of the refractory bricks. Each jamb block assembly is comprised of a plurality of jamb blocks positioned side-by-side. Each of the jamb block assemblies has a lower end supported by the plurality of courses of refractory bricks, and inner surfaces facing the distal ends of the sill block assembly. The inner surfaces of the jamb block assemblies and the upper surface of the sill block assembly form the slag opening in the furnace.

An advantage of the present invention is a refractory sill and jamb assembly that forms an opening in an electric arc furnace.

Another advantage of the present invention is a refractory sill and jamb assembly as described above that provides added stability to openings in an electric arc furnace.

Another advantage of the present invention is a refractory sill and jamb assembly as described above that is less susceptible to damage during slag removal processes.

Another advantage of the present invention is a refractory sill and jamb assembly as described above that is formed of an assembly of refractory blocks.

Another advantage of the present invention is a refractory sill and jamb assembly as described above, wherein a plurality of the refractory blocks are joined together to form a block assembly for insertion and assembly together in a furnace.

Another advantage of the present invention is a refractory sill and jamb assembly as described above, wherein the refractory blocks include metal elements that fuse and weld together during a furnace heat to join the blocks together into an integral unit.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
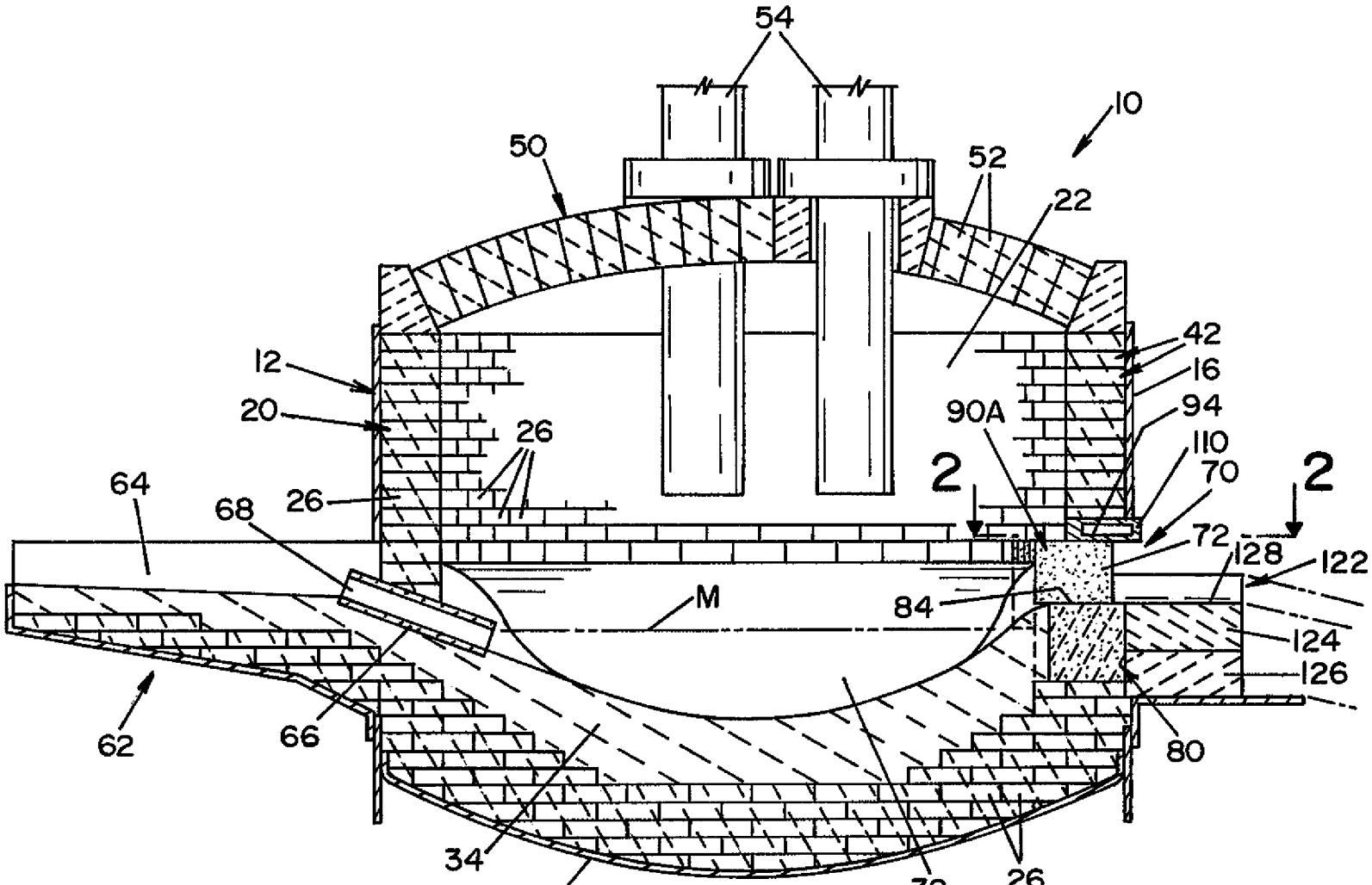
FIG. 1 is a cross-sectional, elevational view of an electric arc furnace.

Referring now to the drawings wherein the showings are for the purpose of illustrating a preferred embodiment of the invention only and not for the purpose of limiting same, FIG. 1 is a cross-sectional, elevational view of an electric arc furnace (EAF) 10 showing a sill and door jamb assembly 70, according to the present invention.

Furnace 10 is comprised of a metallic shell 12 having a bowl-shaped bottom wall 14 and a side wall 16. A refractory lining 20 is disposed along the inner surfaces of metallic shell 12 and defines inner furnace chamber 22. Refractory lining 20 is comprised primarily of refractory bricks 26. Refractory bricks 26 line the bowl-shaped bottom wall 14 to form a concave cavity 32 at the lower end of furnace chamber 22. The upper surfaces of refractory brick 26 that line bottom wall 14 are coated or covered with a refractory layer 34. Refractory layer 34 may be comprised of a dry, vibratable refractory material, a ramming refractory or a sprayed or gunned refractory material. Refractory layer 34 is applied to refractory bricks 26 to maintain a concave, cupped-shaped cavity 32 along the bottom of furnace 10. Refractory bricks 26 are stacked along the inner surface of side wall 16 in a plurality of ring-like courses, designated 42 (see FIG. 3) in the drawings, with one course 42 being stacked upon another.

A removable furnace roof 50 formed of refractory roof blocks 52 is supported on side wall 16, and refractory bricks 26 that line the inner surface of side wall 16. One or more graphite electrodes 54 extend through furnace roof 50 into furnace chamber 22. A typical alternating current furnace has three electrodes. The electrodes are typically elongated, cylindrical shapes.

A spout 62 is formed to extend to one side of furnace 10. Spout 62 defines a pouring channel 64 that communicates with concave cavity 32 within furnace chamber 22 by means of a tapping spout 66, as best seen in FIG. 1. Furnace 10 is built on a tilting platform (not shown) so that liquid steel can be poured into another vessel (not shown) through a tap hole 68 in tapping spout 66 during a steel-making process. The operation of tilting the furnace to pour off molten steel is conventionally referred to as "tapping." Furnace 10 is heretofore described as a conventional electric arc furnace that, in and of itself, forms no part of the present invention.

Figure 2:
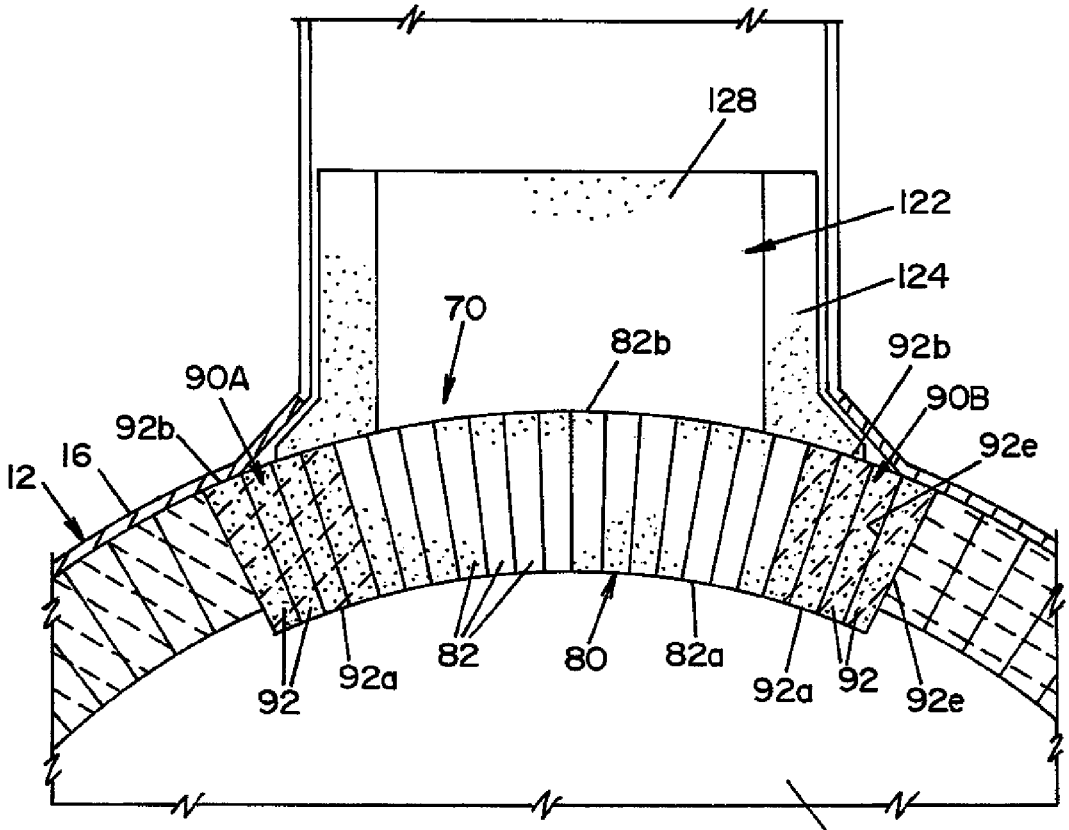
FIG. 2 is a view taken along lines 2-2 of FIG. 1, showing a top view of a sill and jamb assembly defining a slag opening in the electric arc furnace of FIG. 1.
Figure 3:
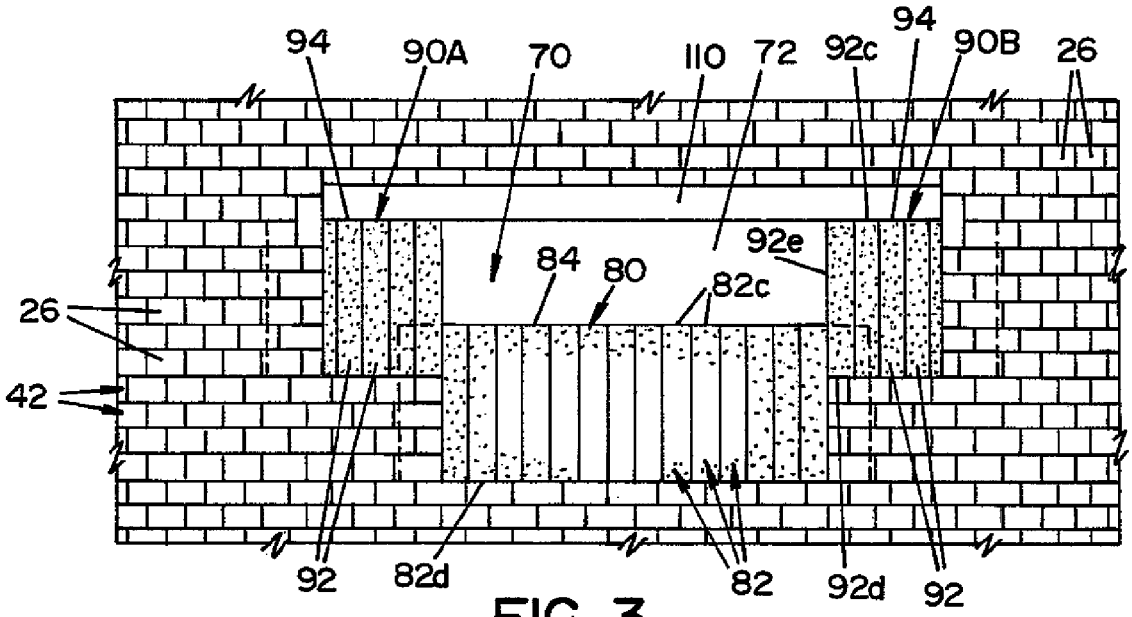
FIG. 3 is an elevational view of the sill and jamb assembly shown in FIG. 2 as seen from inside the electric arc furnace looking out through the slag opening.

Referring now to FIGS. 2 and 3, a sill and door jamb assembly 70 forms an opening 72 through the side of furnace 10. In the embodiment shown, opening 72 defines a slag opening for removing slag that forms on the surface of molten metal within furnace 10. Sill and door jamb assembly 70 is comprised of a sill assembly 80 and two door jamb assemblies 90A, 90B. Sill assembly 80 is comprised of a plurality of like refractory blocks 82 arranged side-by-side to form a bowed, i.e., curved, segment along the inner surface of side wall 16 of metallic shell 12. Each refractory block 82 is generally wedge-shaped, and has an inner surface 82*a* oriented toward furnace chamber 22 and an outer surface 82*b* oriented outwardly toward side wall 16 of metallic shell 12 (see FIG. 4). The inner end of each sill block 82 is thinner, i.e., narrower, than the outer end of sill block 82 such that block 82 has a wedge-shaped configuration. Each sill block 82 has a planar upper surface 82*c*, a planar lower surface 82*d* and planar side surfaces 82*e*.

Figure 4:
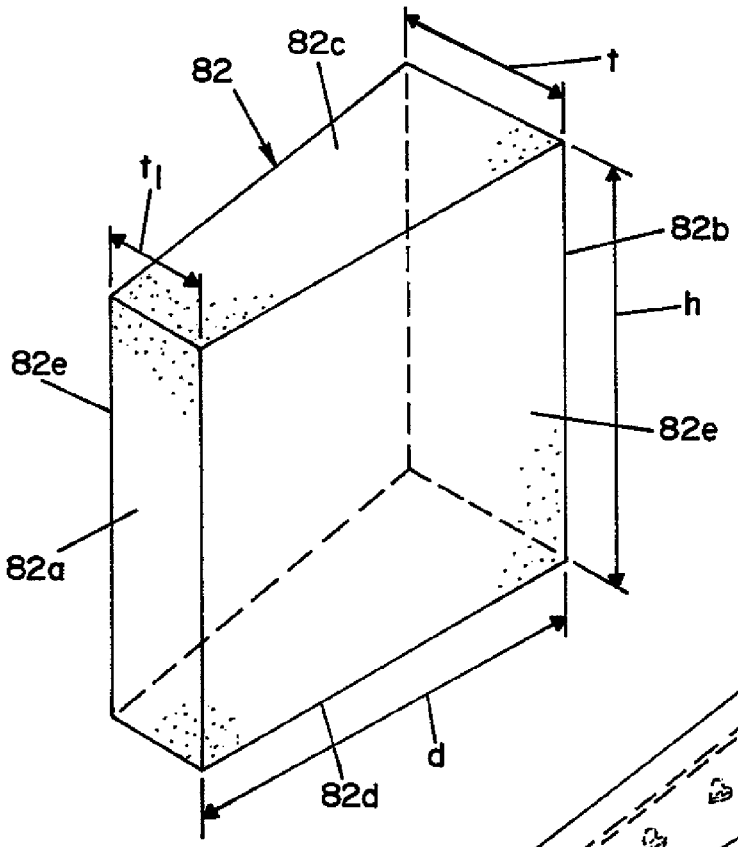
FIG. 4 is a perspective view of a refractory block used in forming the sill and jamb assembly, as shown in FIGS. 2 and 3.

FIG. 4 illustrates one embodiment of a sill block according to the present invention. The dimensions of sill block 82 may vary. The depth "d" of a sill block, i.e., the distance from front surface 82*a* to back surface 82*b*, is at least equal to the length of refractory bricks 26 forming the refractory lining along the inner surface of metallic shell 12. In the embodiment shown, sill blocks 82 have a depth "d" that is greater than the dimensions of refractory brick 26. In a preferred embodiment, a sill block has a depth "d" between about 9 to 24 inches, preferably 12 to 18 inches, and a thickness "$t_1$" at front surface 82*a* of about 3 to about 4 inches, and a thickness "t" at back surface 82*b* of between about 4 to about 5 inches. The height "h" of refractory block 82 is preferably between about 9 and about 24 inches. In the embodiment shown, fourteen (14), like-shaped refractory blocks form sill assembly 80. In one embodiment, refractory blocks 82 have a height "h" of about 18 inches. Sill assembly 80 defines a generally smooth, continuous upper sill surface 84 that in the embodiment shown is a flat, planar surface (see FIG. 3). As will be appreciated from a further reading of the specification, upper surface 82*c* of each individual block 82 may be formed such that when assembled together, the upper sill surface 84 of sill assembly 80 may be contoured, sloping or otherwise non-planar.

Sill assembly 80 is disposed within furnace 10 such that upper sill surface 84 of sill assembly 80 is disposed above a level "M" that represents the level of molten metal within furnace 10 during a steel-making operation. In the embodiment shown, sill assembly 80 rests upon a course (ring) 42 of refractory bricks 26 that lines the inner surface of metallic shell 12, as best seen in FIG. 3. As will be appreciated, sill assembly 80 may rest upon other types of refractory shapes or other refractory materials that form the lower end of furnace 10. A plurality of courses 42 of refractory bricks 26 captures the lower end of sill assembly 80, as best seen in FIG. 3. The ends of each course or row 42 of bricks 26 abut side surfaces 82*e* of the outermost sill blocks 82 of sill assembly 80. In this respect, because of the wedge shape of each of sill blocks 82, the lower end of blocks 82 are locked into place by refractory bricks 26, and form part of a continuous ring 42 of refractory bricks 26 that is disposed along the inner surface of metallic shell 12. In the embodiment shown, four courses 42 of refractory bricks 26 abut the lower end of sill assembly 80.

Abutting the upper ends of sill assembly 80 are door jamb assemblies 90A, 90B. Door jamb assemblies 90A, 90B are each formed of refractory blocks 92. In the embodiment shown, door jamb blocks 92 are similar to sill blocks 82. In this respect, each block 92 is generally wedge-shaped, and has a front surface 92*a*, a back surface 92*b*, an upper surface 92*c*, a bottom surface 92*d* and opposing side surfaces 92*e*.

The lower end of each door jamb assembly 90A, 90B rests on the ends of four courses 42 of refractory brick 26 that abut and hold sill assembly 80 in position, as best seen in FIG. 3. In this configuration, lower ends of door jamb assemblies 90A and 90B respectfully abut the upper ends of sill assemblies 80. More specifically, side surfaces 92*e* of door jamb assemblies 90 abut outer facing, side surfaces 82*e* of sill assembly 80. As best seen in FIG. 3, each door jamb assembly 90A, 90B extends a predetermined distance above upper sill surface 84 of sill assembly 80. Each door jamb assembly 90A, 90B has a planar, upper surface 94 that supports a header member 110 that is formed of refractory material. The inner facing side surfaces 92*e* of door jamb assemblies 90A, 90B and sill surface 84 of sill assembly 80, together with the lower surface of header 110, define opening 72 through the side of furnace 10. Courses 42 of bricks 26 are continued up along the inner surface of metallic shell 12 to enclose door jamb assemblies 90A, 90B and header assembly 110, as illustrated in FIG. 3.

In the embodiment shown, opening 72 in furnace 10 is generally rectangular in shape and extends from furnace chamber 22 through the refractory furnace wall. A breast assembly 122 comprised of an upper refractory breast block 124 and a lower refractory breast block 126 are disposed outside of furnace 10. Breast assembly 122 is aligned with slag opening 72. Upper breast block 124 defines a channel 128 that is aligned with slag opening 72 in furnace 10.

Sill and door jamb assembly 70 described heretofore are essentially comprised of like refractory blocks 82 of the type shown in FIG. 4. Blocks 82 of the type shown in FIG. 4 are assembled in position during construction of side wall 16 of furnace 10.

The blocks are preferably made from magnesia-carbon brick such as EAF 8832 AS, manufactured by North American Refractories Company.

Figure 5:
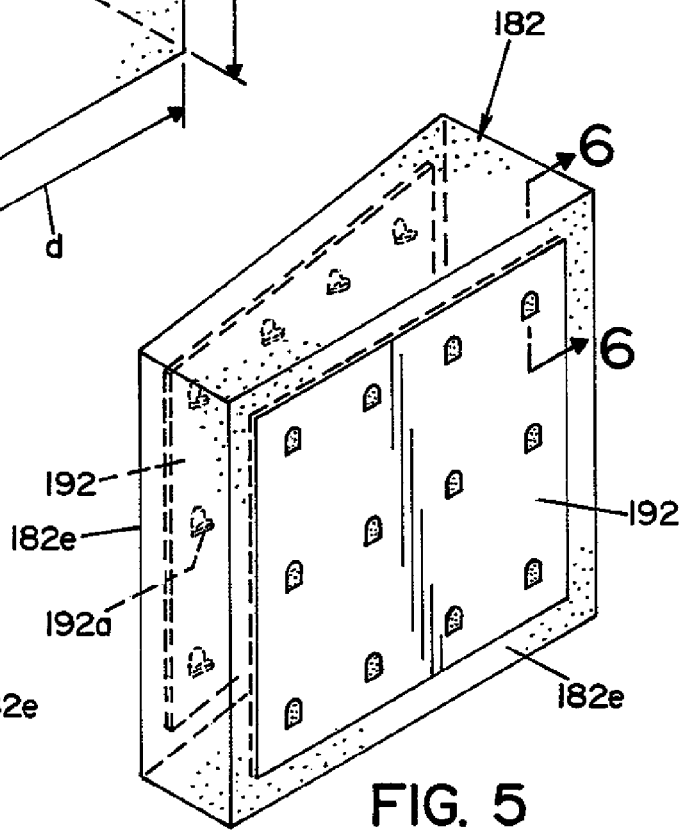
FIG. 5 is a perspective view of an alternate embodiment of a refractory block used in forming the sill and jamb assembly shown in FIGS. 2 and 3.
Figure 6:
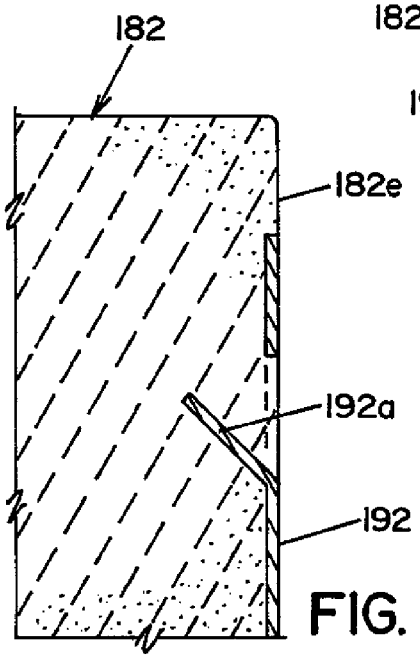
FIG. 6 is a sectional view taken along lines 6-6 of FIG. 5.

Referring now to FIGS. 5 and 6, a refractory block 182 illustrating an alternate embodiment of the present invention is shown. Refractory block 182 used to form a sill and door jamb assembly 70 as heretofore described is shown. Refractory block 182 has the same overall configuration and sizes heretofore described with respect to refractory block 82. Refractory block 182, shown in FIGS. 5 and 6, includes a metal plate 192 co-molded into each of opposite facing side surfaces 182*e*. As best seen in FIG. 6, plate 192 is embedded into the surface of block 182 such that the outer surface of plate 192 and side surface 182*e* of block 182 are co-planar. To facilitate better bonding between the refractory material and metallic plates, tabs 192*a* are punched or otherwise formed through plates 192 to extend to one side thereof. When co-molded, tabs 192*a* facilitate the locking of plates 192 to refractory block 182. Refractory block 182 shown in FIGS. 5 and 6 is used to form sill and door jamb assembly 70 in the same manner as previously described. Refractory blocks 182 are preferably used in forming sill assembly 80, the lower portion of which is exposed to molten metal within furnace 10 during a steel forming operation. In this respect, with refractory blocks 182 in place, metal plates 192 on adjacent blocks 182 are in contact with each other. During a melt in the furnace, metal plates 192 tend to fuse or weld themselves to each other as a result of the exposure to the high temperatures of the molten metal within furnace 10. As a result, refractory blocks 182 bond to each other to form a unitary sill assembly 80 when exposed to the operating temperatures within furnace 10. The joined or connected blocks 182 make sill assembly 80 less susceptible to shifting or deterioration as a result of impacts during any slag removal process. As will be appreciated, refractory blocks 182 also find advantageous application in forming door jamb assemblies 90A and 90B.

Depending upon the size of refractory blocks 182 used to form sill assembly 80 and/or door jamb assembly 90, movement and assembly of respective blocks 82, 182 may be complicated as a result of the weight of such blocks 82, 182. In accordance with another aspect of the present invention, block sub-assemblies comprised of a plurality of blocks 82 or 182 may be formed to facilitate insertion of multiple blocks 82, 182 using cranes or overhead lifting devices.

Figure 7:
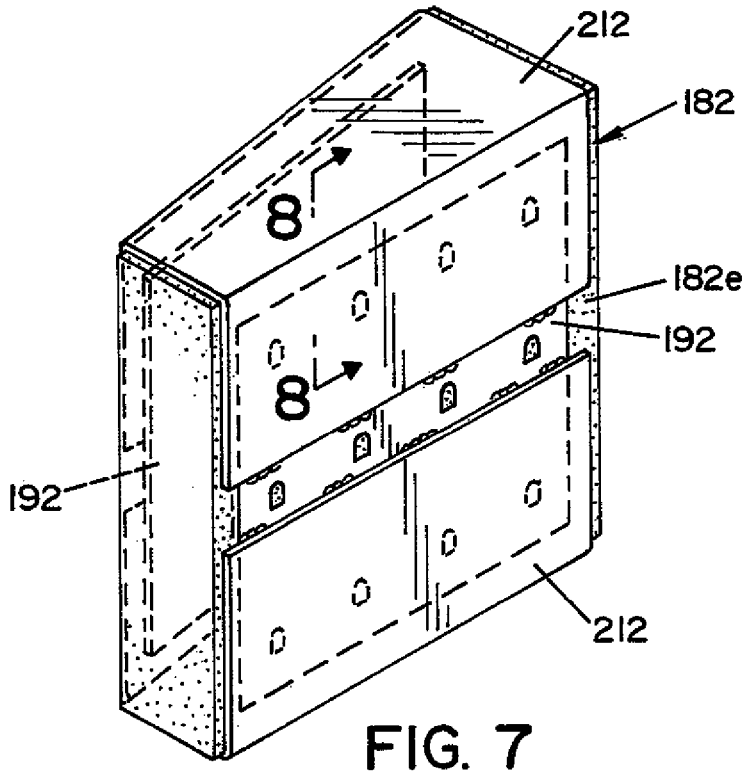
FIG. 7 is a perspective view of yet another embodiment of a refractory block for forming the sill and jamb assembly shown in FIGS. 2 and 3.
Figure 8:
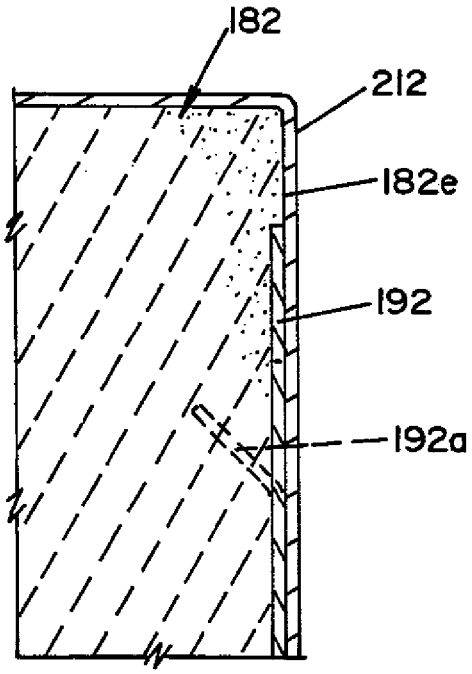
FIG. 8 is a sectional view taken along lines 8-8 of FIG. 7.
Figure 9:
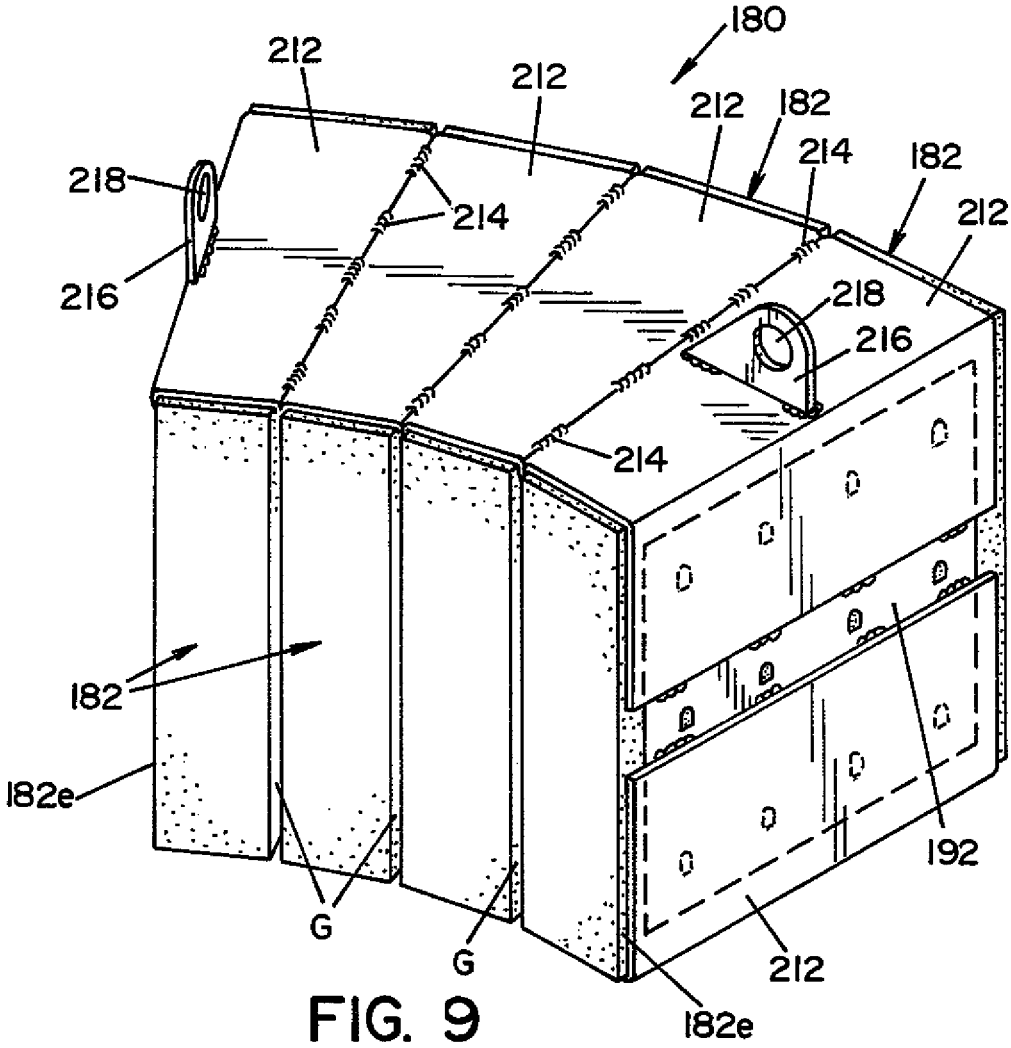
FIG. 9 is a perspective view of a block assembly formed from refractory blocks shown in FIG. 7.

FIGS. 7 and 8 show modification to blocks 182 to facilitate handling of multiple blocks 182. FIG. 7 shows block 182 having generally U-shaped metal casings 212 covering the upper end and lower end of a refractory block. Casings 212 are formed of relatively thin steel sheet. As illustrated in FIGS. 7 and 8, casings 212 are welded to metal plates 192 of refractory block 182 to secure casings 212 to block 182. With the U-shaped casings 212 attached to the upper and lower ends of a block 182, a plurality of blocks 182 may be pre-assembled side-to-side and joined together by welds 214 across the edges of casings 212 on adjacent blocks, as illustrated in FIG. 9. Lifting tabs 216 may then be attached to metal casings 212, as further illustrated in FIG. 9, to provide lifting means to lift a multiple block sub-assembly 210 and to position same within furnace 10.

Because of U-shaped casings 212 on the upper and lower ends of blocks 182, a slight gap "G" will exist between the front surfaces of blocks 182, as illustrated in FIG. 9. As indicated above, any molten metal that penetrates these gaps "G" would essentially fuse or weld metal plates 192 together thereby forming a barrier to further penetration into blocks 182.

Figure 10:
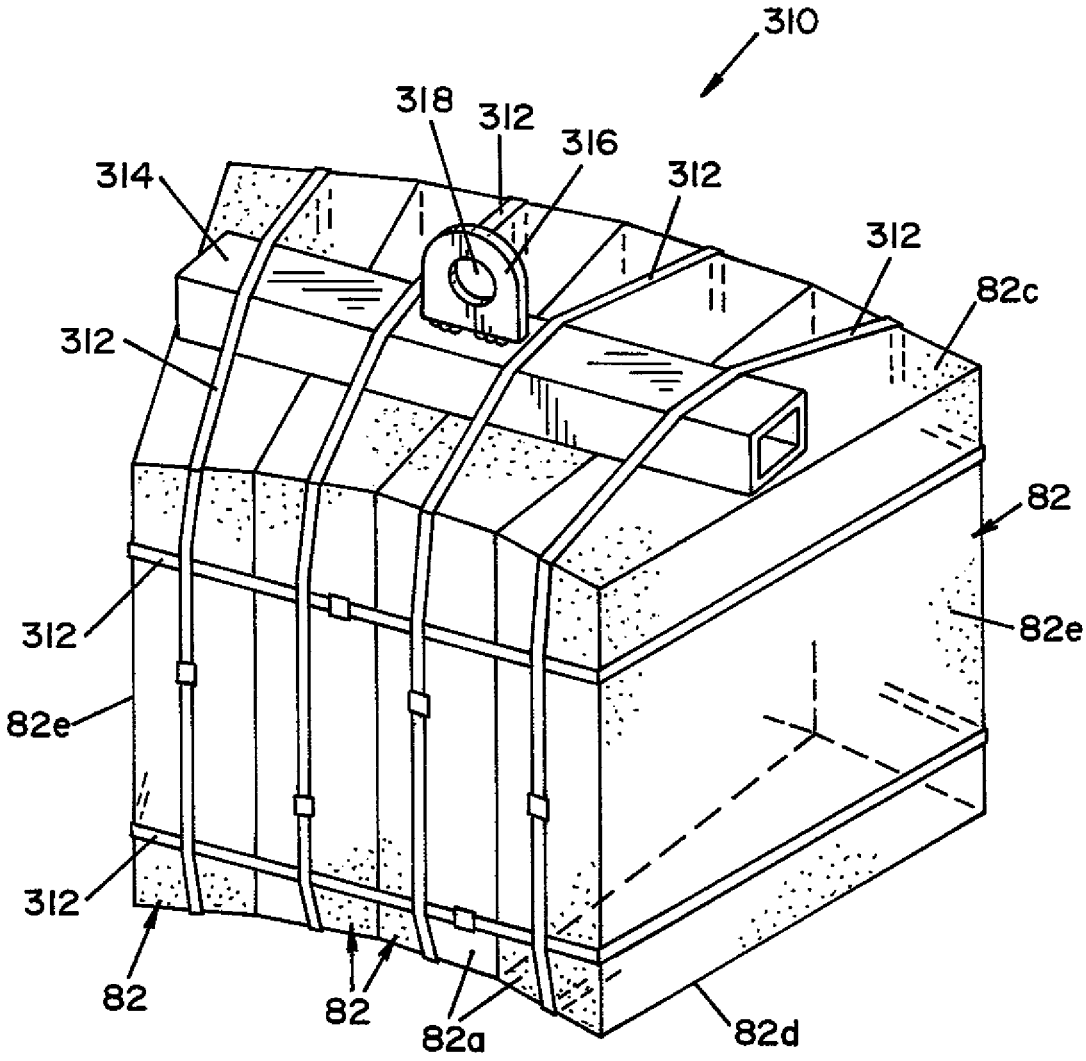
FIG. 10 is a perspective view of a block assembly formed from refractory blocks shown in FIG. 4.

Referring now to FIG. 10, a block sub-assembly 310, illustrating another aspect of the present invention, is shown. Block sub-assembly 310 is formed from a plurality of refractory blocks 82 that are joined together using metallic bands or straps 312 that extend around the top and bottom of blocks 82 and around the front and back of blocks 82. A support beam 314 is attached to blocks 82 by means of metallic bands 312. Bands 312 are preferably comprised of conventional steel bands used in banding bulk items, such as bricks or lumber. In the embodiment shown, support beam 314 is comprised of a rectangular steel pipe. The steel pipe includes a lifting tab 316 having an aperture 318 therethrough to allow block sub-assembly 310 to be lifted and set into place using an overhead crane or other type of lifting device. Once set in place, bands 312 maybe cut away to release support beam 314 from block assembly 310. Portions of bands 312 that are accessible may be cut away using conventional tin snips or grinding tools. The present invention thus provides a sill and door jamb assembly 70 for forming an opening 72 in an electric arc furnace 10 by means of large refractory blocks 82, 182 that are less susceptible to damage and dislodgement as a result of impact tools being used thereon during a slag removal process. Further, when adjoining plates 192 on adjacent blocks 182 weld together, movement or distortion of a block 182 is less likely, as compared to individual refractory bricks 26 used heretofore to form an opening in an electric arc furnace.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, although the refractory blocks were heretofore described as generally wedge-shaped, other shapes, such as, by way of example and not limitation, rectangular blocks or a combination of rectangular blocks and wedge-shaped blocks, could be used to form the jamb and sill assemblies. It is intended that all such modifications and alterations be included insofar as they come within the scope of the invention as claimed or the equivalents thereof.

Having described the invention, the following is claimed:

1. In an electric arc furnace having a shell comprised of side walls and a bottom and a refractory layer lining the bottom and side walls, said refractory layer including continuous courses of refractory bricks along the inner surface of said side walls of said shell, a slag opening, comprised of:

a sill block assembly and two jamb block assemblies defining an opening;

said sill block assembly comprised of side-by-side sill blocks, each of said sill blocks having an upper end with an upper surface, a lower end with a lower surface, and an inner surface facing the interior of said furnace, said sill blocks positioned side-by-side with the upper surfaces of said side-by-side sill blocks defining an upper surface of an upper end of said sill block assembly and the lower surfaces of said side-by-side sill blocks defining a lower surface of a lower end of said sill block assembly, said lower surfaces of said sill assembly resting on said continuous courses of refractory bricks along the inner surface of said side walls of said shell with said lower end of said sill block assembly disposed between a plurality of courses of said refractory bricks; and each of said jamb block assemblies comprised of a plurality of jamb blocks positioned side-by-side, each of said jamb block assemblies having a lower end supported on said continuous courses of refractory bricks, each of said jamb block assemblies having generally opposite-facing side surfaces, each of said side surfaces of a jamb block assembly being defined entirely by a side surface of an outermost jamb block, one of said side surfaces of a jamb block assembly abutting ends of a plurality of said continuous course of refractory bricks and another side of the jamb block assembly having a portion abutting said upper end of said sill block assembly and another portion extending above the upper surface of said sill block assembly wherein said another portion of said another side of said jamb block assembly and said upper surface of said sill block assembly form the entire side and bottom respectively of said slag opening in said furnace, said sill blocks and said jamb blocks being formed of a refractory material.

2. An electric arc furnace as defined in claim 1, wherein a metallic element is embedded into a side surface of each of said sill blocks and said jamb blocks, said metallic element in one sill block abutting a metallic element in another adjacent sill block when said one sill block and said another sill block are positioned side-by-side, and said metallic element in one jamb block abutting a metallic element in another adjacent jamb block when said one jamb block and said another jamb block are positioned side-by-side.

3. An electric arc furnace as defined in claim 2, wherein said metallic element is a flat, metallic plate.

4. An electric arc furnace as defined in claim 3, wherein said plate is co-molded into a side surface of each of said sill blocks and into a side surface of each of said jamb blocks.

5. An electric arc furnace as defined in claim 1, wherein said sill assembly is comprised of one or more sill sub-assemblies, each of said sill sub-assemblies comprised of a plurality of sill blocks held together side-by-side.

6. An electric arc furnace as defined in claim 5, wherein said plurality of sill blocks are welded together.

7. An electric arc furnace as defined in claim 6, wherein a metallic element is embedded into a side surface of said sill blocks, said metallic element in one sill block abutting a metallic element in another adjacent sill block when said one sill block and said another sill block are positioned side-by-side.

8. An electric arc furnace as defined in claim 6, wherein each of said plurality of sill blocks includes a generally U-shaped metallic casing covering the upper end of said sill block.

9. An electric arc furnace as defined in claim 8, wherein a metallic element is embedded into a side surface of said sill blocks, said metallic element in one sill block abutting a metallic element in another adjacent sill block when said one sill block and said another sill block are positioned side-by-side, and said casing is welded to said metallic element.

10. An electric arc furnace as defined in claim 5, wherein lifting means are attached to said sill sub-assemblies to facilitate lifting of the same.

11. An electric arc furnace as defined in claim 10, wherein said lifting means is a beam attached to a sub-assembly.

12. An electric arc furnace as defined in claim 5, wherein said plurality of sill blocks are held together by metallic bands wrapped around said sill blocks.

13. An electric arc furnace as defined in claim 12, wherein a lifting device is attached to said sill blocks by said metallic bands.

14. An electric arc furnace as defined in claim 13, wherein said lifting device is an elongated pipe.

15. An electric arc furnace as defined in claim 1, wherein the upper end of said sill assembly has a continuous flat, upper surface.

16. An electric arc furnace as defined in claim 15, wherein said upper surface is planar and horizontal.

17. An electric arc furnace as defined in claim 1, wherein said jamb assembly is comprised of one or more jamb sub-assemblies, each of said jamb sub-assemblies comprised of a plurality of jamb blocks held together side-by-side.

18. An electric arc furnace as defined in claim 17, wherein said plurality of jamb blocks are welded together.

19. An electric arc furnace as defined in claim 18, wherein a metallic element is embedded into a side surface of said jamb blocks, said metallic element in one jamb block abutting a metallic element in another adjacent jamb block when said one jamb block and said another jamb block are positioned side-by-side.

20. An electric arc furnace as defined in claim 18, wherein each of said plurality of jamb blocks includes a generally U-shaped metallic casing covering the upper end of said jamb block.

21. An electric arc furnace as defined in claim 20, wherein a metallic element is embedded into a side surface of said jamb blocks, said metallic element in one jamb block abutting a metallic element in another adjacent jamb block when said one jamb block and said another jamb block are positioned side-by-side, and said casing is welded to said metallic element.

22. An electric arc furnace as defined in claim 17, wherein lifting means are attached to said jamb sub-assemblies to facilitate lifting of the same.

23. An electric arc furnace as defined in claim 22, wherein said lifting means is a beam attached to a sub-assembly.

24. An electric arc furnace as defined in claim 17, wherein said plurality of jamb blocks are held together by metallic bands wrapped around said jamb blocks.

25. An electric arc furnace as defined in claim 24, wherein a lifting device is attached to said jamb blocks by said metallic bands.

26. An electric arc furnace as defined in claim 25, wherein said lifting device is an elongated pipe.

* * * * *